United States Patent [19]

Merry

[11] Patent Number: 4,838,442

[45] Date of Patent: Jun. 13, 1989

[54] PRODUCT PRESERVING STOPPER

[75] Inventor: Glenn W. Merry, San Francisco, Calif.

[73] Assignee: Matsi, Inc., San Francisco, Calif.

[21] Appl. No.: 212,808

[22] Filed: Jun. 29, 1988

[51] Int. Cl.[4] ..... B65D 85/72

[52] U.S. Cl. ..... 215/228; 206/525; 206/601; 426/118; 426/124

[58] Field of Search ..... 215/228, 231; 206/204, 206/205, 601, 525; 426/118, 124, 395, 398

[56] References Cited

U.S. PATENT DOCUMENTS

| | | | |
|---|---|---|---|
| 1,584,903 | 5/1926 | Supplee . | |
| 2,915,404 | 12/1959 | Tessmer . | |
| 3,305,730 | 5/1962 | Walker . | |
| 3,220,555 | 11/1965 | Silha . | |
| 4,055,672 | 10/1977 | Hirsch et al. | 426/127 |
| 4,279,350 | 7/1981 | King | 215/228 |
| 4,279,995 | 9/1981 | Moriya | 215/228 |
| 4,350,508 | 9/1982 | Santoro et al. | 215/228 X |
| 4,421,235 | 12/1983 | Moriya | 215/228 X |
| 4,545,492 | 10/1985 | Firestone | 215/228 X |

OTHER PUBLICATIONS

Kirk-Othmer, *Encyclopedia of Chemical Technology*, 3rd Ed., vol. 3, pp. 532–534.

*Primary Examiner*—Donald F. Norton

*Attorney, Agent, or Firm*—Townsend and Townsend

[57] ABSTRACT

A product preserving stopper (2) is used to seal the opening (62) in a container (28) and remove oxygen within the container. This accomplished by incorporating a metal-air primary cell (32) into the construction of the stopper. The cathode of the cell is open to the interior (26) of the container so that by electrically connecting the anode and cathode, typically by shorting out the anode can (36) to the cathode can (34) using a resilient contact (40), any oxygen in the container is removed through the action of the metal-air primary cell. Electrical connection between the contact and cell is initially prevented by placement of a removable separator tab (48) between the contact and the anode can. The stopper becomes actuated only after removal of the separator tab by the user to lengthen the shelf life of the cell. Preferably the stopper is packaged within an oxygen impermeable package (70) to further increase the shelf life.

16 Claims, 2 Drawing Sheets

PRODUCT PRESERVING STOPPER

BACKGROUND OF THE INVENTION

Many beverages, in particular wine, are sensitive to the presence of oxygen. Wine bottles are often filled with an inert gas, such as nitrogen, before filling with wine so that the space between the wine and the cork contains virtually no oxygen. The amount of oxygen which may seep through the cork is usually small enough so as not to be a problem.

The greatest problem of oxygen in a wine bottle usually arises after a wine bottle has been opened, some of the wine has been consumed and the remainder has been stored for one or more days. One way to reduce this problem is by injecting nitrogen into the space above the wine and then quickly recorking or otherwise resealing the bottle. This of course is only as effective as the seal provided by the cork and the effectiveness of purging the wine bottle of oxygen. Another scheme for reducing the harmful effects of oxygen in an open bottle of wine places the interior of the wine bottle at a partial vacuum. This of course only removes part of the air, of which about twenty-percent is oxygen, and so does not solve the problem, especially for oxygen sensitive wines, such as many white wines.

SUMMARY OF THE INVENTION

The present invention is directed to a product preserving stopper, particularly useful for preserving wines and other oxygen-sensitive beverages, which continuously removes oxygen from the interior of the container so to preserve the product.

The stopper has a body, a portion of which is sized to seal the opening of the container. A metal-air primary cell, typically a zinc-air primary cell, is mounted to the stopper body. The cell is of the type which has openings, to allow oxygen, typically as a constituent of air, to contact the cell's cathode to produce an electrical potential between the anode and the cathode of the cell. As is conventional, the anode is electrically connected to an anode can and the cathode is electrically connected to a cathode can. The cell is positioned so that the openings leading to the cathode are in fluid communication with the interior of the container.

An electrical conductor is used to connect the anode and the cathode so that the battery discharges until all the oxygen within the container is removed. Preferably the electrical connector is movable so that electrical connection between the anode and cathode occurs only when the user wishes to place the stopper into service. In the preferred embodiment this is achieved by placing a removable separator tab between one end of the electrical connector and the anode can thus isolating the anode and cathode until the tab is pulled from the stopper allowing the electrical connector to contact the anode thus activating the cell.

Other features and advantages will appear from the following descriptions in which the preferred embodiment has been set forth in detail in conjunction with the accompanying drawings.

DETAILED DESCRIPTION OF THE PREFERRED EMBODIMENT

Figure 1:
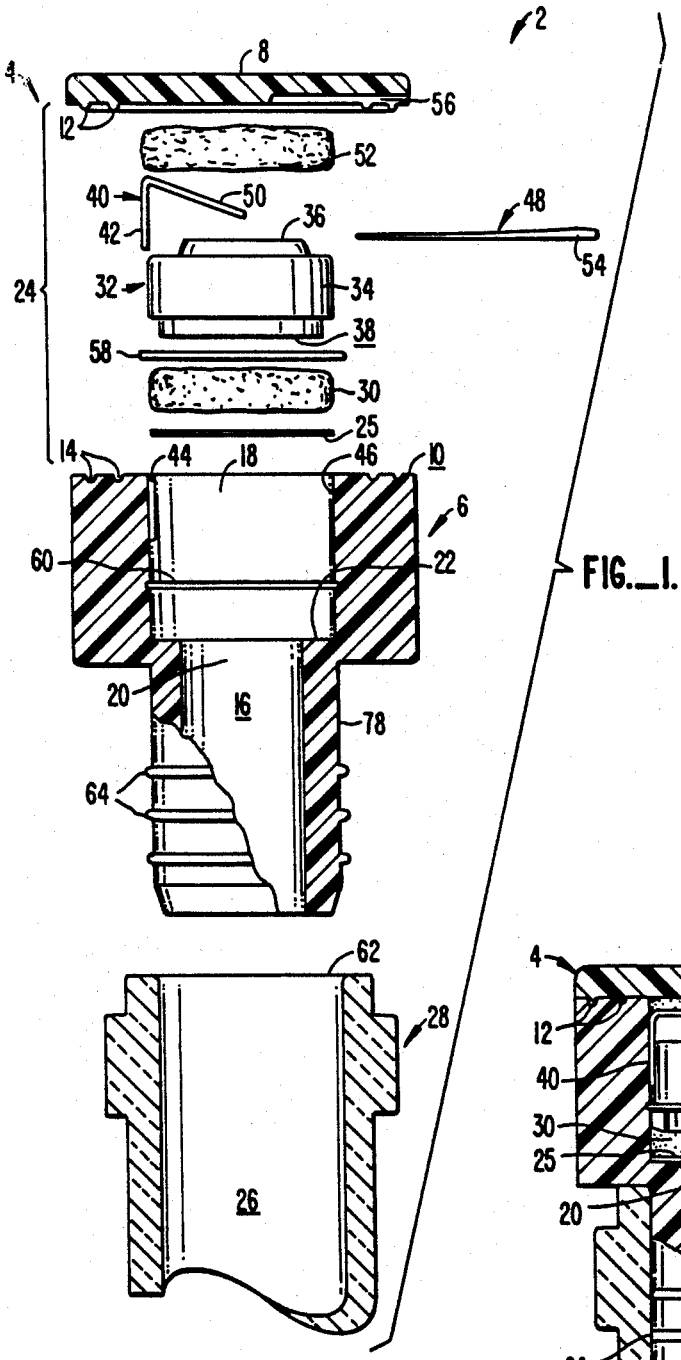
FIG. 1 is an exploded partial cross-sectional view of a beverage preserving stopper shown in conjunction with a neck of a bottle.
Figure 2:
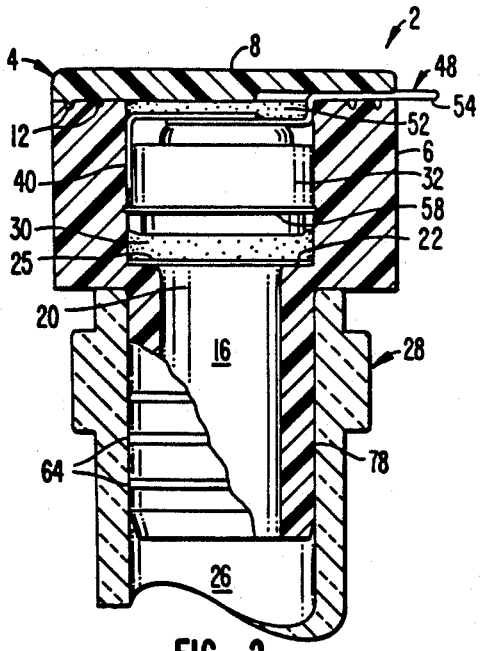
FIG. 2 is a side view similar to that of FIG. 1 but in an assembled condition.

Referring now to FIGS. 1 and 2, a beverage preserving stopper 2 is seen to include a stopper body 4 having a stopper base 6 and a stopper lid 8, the lid being heat sealed, or otherwise attached, to an upper surface 10 of base 6. Lid 8 and base 6 have corresponding circular ridges and grooves 12, 14 to aid proper positioning of lid 8 onto base 6. Base 6 has a central bore 16, including upper and lower portions 18, 20 with a shoulder 22 at the junction therebetween.

Enlarged upper portion 18 houses an oxygen removing assembly 24. Assembly 24 includes an oxygen permeable hydrophobic layer 25 which is heat sealed to shoulder 22. Layer 25 permits air, in particular oxygen, to pass from lower portion 20, and thus from the interior 26 of bottle 28, into upper portion 18. Layer 25 may be made of polyethylene, polypropylene or PTFE, as well as other materials. One such material is sold under the trademark POREX by Porex Technologies Corp. of Fairburn, Ga. Adjacent hydrophobic layer 25 is a hydrophilic layer 30 to attract any liquids while allowing oxygen to pass to the metal-air primary cell 32 directly above layer 30. Layer 30 may be a 100% cotton mat sold under the trademark WEBRIL by Kendall Company of Walpole, Mass. Hydrophilic layer 30 not only will absorb moisture which may pass hydrophobic layer 26 but also any leakage from the metal-air cell 32, located above layer 30, which may occur.

Cell 32 is preferably a zinc-air primary cell of conventional design, such as that made by Duracell of Bethel, Conn. Cell 32 includes a cathode can 34 and an anode can 36 electrically isolated from cathode can 34. Cathode can 34 has a number of openings (not shown) in its surface 38 which face hydrophilic layer 30 to permit oxygen to enter cell 32. An L-shaped resilient contact 40 has a first leg 42 which is positioned for placement between cathode can 34 and an undercut 44 within in the circumferential wall 46 bounding upper portion 18 of central bore 16. A removable separator tab 48 is positioned between a second leg 50 of resilient contact 40 and anode can 36 to interrupt the electrical path which is otherwise created by resilient contact 40 between cathode can and anode can 36. A second hydrophilic layer 52 is used between lid 8 and anode can 36 and acts primarily as a resilient positioner to maintain oxygen removing assembly 24 in position within upper portion 18.

A portion 54 of tab 48 extends beyond stopper body 4 by passing through a groove 56 formed in lid 8. This permits the user to remove tab 48 when it is desired to place beverage preserving stopper 2 in service by shorting out anode and cathode cans 34, 36.

An O-ring gasket 58 is used to seal the exterior of cathode can 34 and circumferential wall 46. O-ring 58 is located within upper portion 18 of central bore 16 by an O-ring groove 60 formed in circumferential wall 46. Thus, virtually all oxygen which reaches surface 38 of cathode can 34 comes from interior 26 of bottle 28 once stopper 2 is inserted past the mouth 62 of bottle 28 and sealed within the bottle by a series of sealing rings 64.

Figure 3:
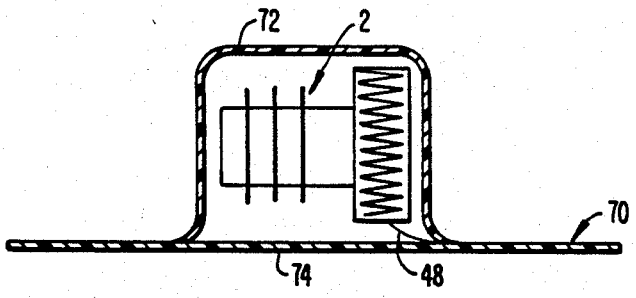
FIG. 3 is a side view of the stopper of FIG. 1 shown housed within a retail sales package.
Figure 4:
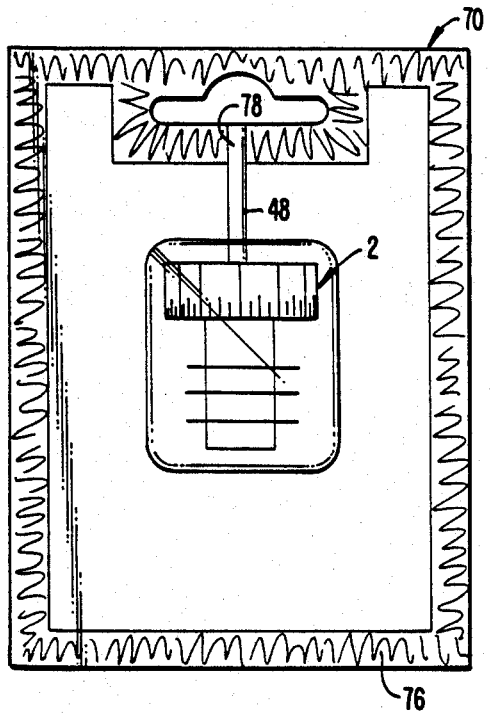
FIG. 4 is a plan view of the stopper and package of FIG. 3.

Turning now to FIGS. 3 and 4, stopper 2 is shown contained within an oxygen-impervious retail package 70. Package 70 includes a formed tray 72 heat sealed to a base sheet 74 around their peripheries 76. The outer portion 54 of tab 48 is sealed between tray 72 and sheet 74 at position 78. Stopper 2 is automatically actuated by removing stopper 2 from package 70.

Stopper 2 is used primarily to preserve wine within a bottle 28 once the bottle has been opened and some of the wine has been removed. Doing so helps to protect the wine against the adverse affects of oxygen which necessarily enters bottle 28 after the bottle is opened. Upon opening bottle 28 and pouring the desired amount of wine, preferably into a carafe if more than one glass is to be poured, stopper 2 is removed from package 70. Doing so causes tab 48 to be pulled from beneath second leg 50 of contact 40 and anode can 36, thus electrically connecting the two. Inserting shank 78 of stopper body 4 through mouth 62 and into bottle 28 permits cell 32 to remove oxygen from interior 26 of bottle 28. Cell 32 is preferably sized so that oxygen within bottle 28 is removed at a sufficiently rapid pace to prevent the beverage within bottle 28 from becoming oxidized or otherwise spoiling. Cell 32 is also preferably sized so that the beverage with bottle 28 can be consumed a glass at a time. As each glass is removed, the volume of air within bottle 28 increases and the oxygen within the bottle is replenished. It has been found that a commercially available zinc air cell having a rating of about 1000 milliampere hours can effectively preserve the beverage in a 750 milliliter container as the beverage is removed in 125 milliliter increments.

The preferred embodiment is not particularly designed for reuse. However, by making stopper lid 8 removable, commercially available metal-air primary cells 32 could be removed and replaced by simply removing the stopper lid 8, the hydrophilic layer 52, the resilient contact 40 and the cell 32 and replacing cell 32 with a fresh cell; the components would then be reassembled for use then (without tab 48) or later (with tab 48 in place).

Other modification and variation can be made to the disclosed embodiment without departing from the subject of the invention as defined in the following claims. For example, if desired, contact 40 could be a two-piece element carried by stopper base 6 and stopper lid 8. Other arrangements of hydrophobic and hydrophilic layers 26, 30 could be used, including the use of a second hydrophobic layer between cell 32 and hydrophilic layer 30.

What is claimed:

1. A product preserving stopper for removing oxygen from the interior of a container, the container having a container opening, the stopper comprising:
   - a stopper body having a portion sized to sealably engage the container opening;
   - a metal-air primary cell, of the type which produces electricity as it uses oxygen, mounted to the stopper body, the cell having an anode, and a cathode adapted to be fluidly connected to the interior of the beverage container;
   - a conductive electrical path between the anode and the cathode so that the cell depletes any oxygen in the interior of the container.

2. The stopper of claim 1 wherein the metal-air primary cell is a zinc-air primary cell.

3. The stopper of claim 1 wherein the cell includes an anode can electrically connected to the anode and a cathode can electrically connected to the cathode.

4. The stopper of claim 3 wherein the cathode can has an opening through which oxygen can pass from the container interior to the cathode.

5. The stopper of claim 3 wherein the conductor electrical path includes a contact electrically connecting the anode can and the cathode can when in a first condition and electrically disconnecting the anode can and the cathode can when in a second condition.

6. The stopper of claim 1 wherein the stopper body includes an open interior adapted to be in fluid communication with the container interior and within which the cell is mounted.

7. The stopper of claim 6 further comprising an oxygen permeable hydrophobic layer between the cell and the bottom of the stopper.

8. The stopper of claim 7 further comprising a hydrophilic layer between the hydrophobic layer and the cell.

9. The stopper of claim 6 wherein the stopper body includes a stopper base having a through bore substantially defining the open interior and a stopper lid secured to an upper end of the stopper base substantially covering one end of the through bore.

10. The stopper of claim 6 wherein the conductive electrical path includes a contact electrically connecting the anode can and the cathode can when in a first condition and electrically disconnecting the anode can and the cathode can with in a second condition.

11. The stopper of claim 10 further comprising a non-conductive removable separator positioned between the contact and a chosen one of the anode can and cathode can when the contact is in the second condition.

12. The stopper of claim 11 wherein the stopper body includes an opening through which a portion of the separator passes for selective removal by a user.

13. The stopper of claim 12 further comprising an oxygen impermeable package within which the stopper is stored before use.

14. The stopper of claim 13 wherein the separator tab is secured to the package so that when the stopper is removed from the package, the separator tab is removed from the stopper to permit the contact to assume its first, normal position.

15. The stopper of claim 1 further comprising an oxygen impermeable package within which the stopper is stored before use.

16. A beverage preserving stopper for removing oxygen from the interior of a bottle, the bottle having a neck terminating in a mouth, the stopper comprising:
   - a stopper body including a hollow base and a lid, the base including an elongate shank and enlarged upper portion, the shank having external sealing surface for sealing engagement within the neck of the bottle, the enlarged upper portion sized to seat against the bottle at the mouth, the base including a central bore extending therethrough from an upper end of the upper portion to a lower end of the shank, the central bore including a lower portion and an enlarged upper portion with a shoulder between the two, the lid covering the central base at the upper end of the upper portion of the base;
   - an oxygen permeable hydrophobic layer secured to the shoulder and dividing the upper and lower portions of the central bore to substantially prevent passage of moisture between the upper and lower portions;

an oxygen permeable hydrophilic layer positioned within the upper portion adjacent the hydrophobic layer;

a metal-air primary cell positioned within the upper portion, the cell including an anode can and a cathode can, the cathode can having openings facing the hydrophilic layer;

an electrical contact element for electrically connecting the anode and cathode cans when in a contact condition and for electrically isolating the anode and cathode cans when in a non-contact condition, the electrical contact element being biased towards the contact condition;

a separator tab removably positioned between a portion of the electrical contact element and a chosen one of the anode and cathode cans to place the electrical contact element in the non-contact condition; and a portion of the separator tab passing freely between the lid and the base so a user can place the electrical contact element in the contact condition by removing the separator tab from the stopper body to permit discharge of the metal-air primary cell so when the shank is within the bottle neck, any oxygen in the interior of the bottle will be removed through the action of the metal-air primary cell.

* * * * *